US007482528B2

(12) United States Patent
Okamoto

(10) Patent No.: US 7,482,528 B2
(45) Date of Patent: Jan. 27, 2009

(54) ELECTRONIC MUSIC APPARATUS CAPABLE OF REPRODUCING COMPOSITE MUSIC FILE, AND PROGRAM THEREFOR

(75) Inventor: Tetsuo Okamoto, Hamamatsu (JP)

(73) Assignee: Yamaha Corporation, Hamamatsu-Shi (JP)

( * ) Notice: Subject to any disclaimer, the term of this patent is extended or adjusted under 35 U.S.C. 154(b) by 535 days.

(21) Appl. No.: 11/065,738

(22) Filed: Feb. 24, 2005

(65) Prior Publication Data

US 2005/0188823 A1 Sep. 1, 2005

(30) Foreign Application Priority Data

Feb. 26, 2004 (JP) ..... 2004-052062

(51) Int. Cl.
*G10H 1/00* (2006.01)
*G10H 1/18* (2006.01)
*G10H 7/00* (2006.01)

(52) U.S. Cl. ..... 84/615; 84/645

(58) Field of Classification Search ..... 84/615, 84/645

See application file for complete search history.

(56) References Cited

U.S. PATENT DOCUMENTS 6,078,951 A * 6/2000 Pashupathy et al. ..... 709/217
2002/0056117 A1 5/2002 Hagesawa et al.
2002/0162445 A1 11/2002 Naples et al.
2005/0145099 A1 * 7/2005 Lengeling et al. ..... 84/645

FOREIGN PATENT DOCUMENTS

BE 1014157 A6 5/2003
WO WO-01/16931 3/2001

* cited by examiner

*Primary Examiner*—Jeffrey Donels
(74) *Attorney, Agent, or Firm*—Morrison & Foerster LLP

(57) ABSTRACT

Composite music file is composed of a content section including a plurality of types of music content, and a header section including content type information of the plurality of types of music content. At least the content type information included in the header section is in a non-encrypted form. Once a composite music file is input, the content type information is read out from the header section of the input composite music file, and one usable music software is selected, on the basis of the content type information, from among a plurality of types of music software capable of reproducing the plurality of types of music content, so that the thus-selected music software is automatically started up.

9 Claims, 3 Drawing Sheets

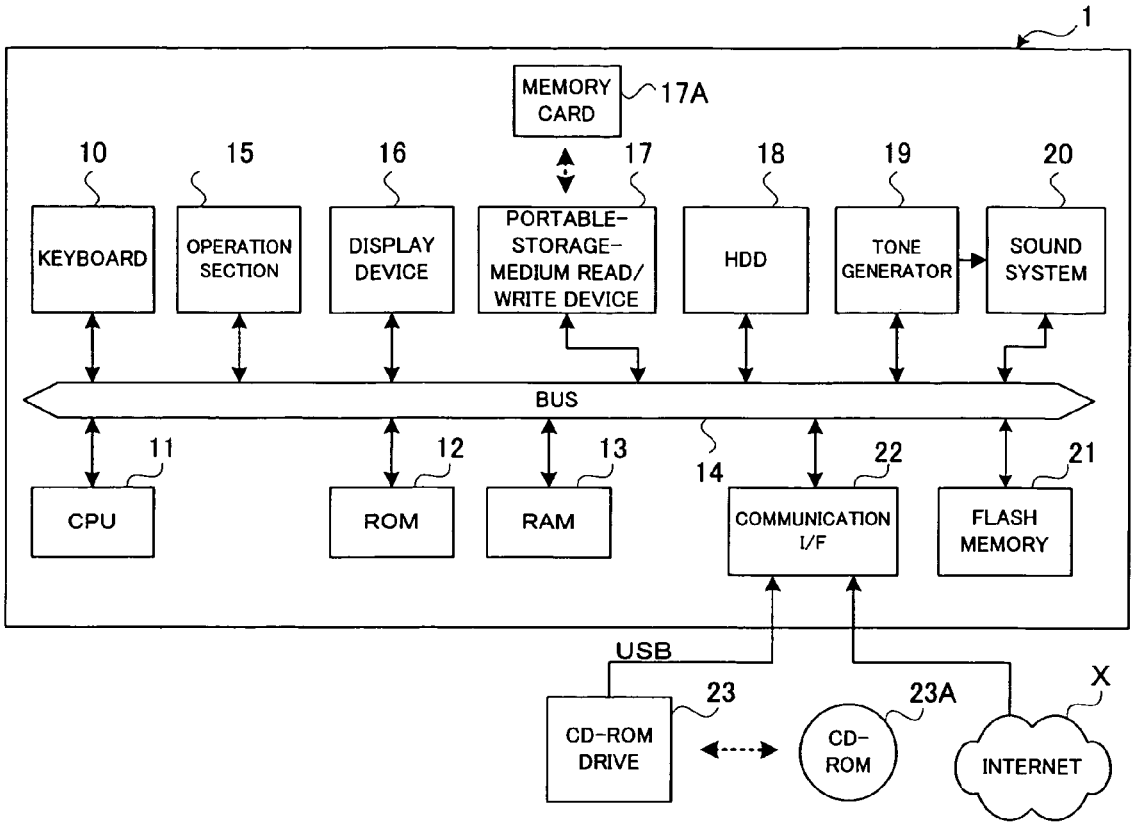
FIG. 1
| | TYPE OF SOFTWARE | TYPE OF MUSIC CONTENT | | | | | |
|---|---|---|---|---|---|---|---|
| | | MIDI | MUSICAL SCORE | STILL IMAGE | ANIMATED IMAGE | SOUND | SETTING INFORMATION |
| A | MUSIC TEACHING SOFTWARE | ○ | — | — | ○ | ○ | ○ |
| B | MUSICAL SCORE DISPLAY | ○ | ○ | — | — | — | — |
| C | MULTIMEDIA SOFTWARE | ○ | ○ | ○ | ○ | ○ | ○ |
| D | AUTOMATIC PERFORMANCE | ○ | — | — | — | ○ | — |
| E | SETTING INFORMATION | — | — | — | — | — | ○ |
| F | SAMPLING SOFTWARE | — | — | — | — | ○ | — |
| G | SEQUENCER SOFTWARE | ○ | — | — | — | ○ | — |
| | | | | | | | |
FIG. 2
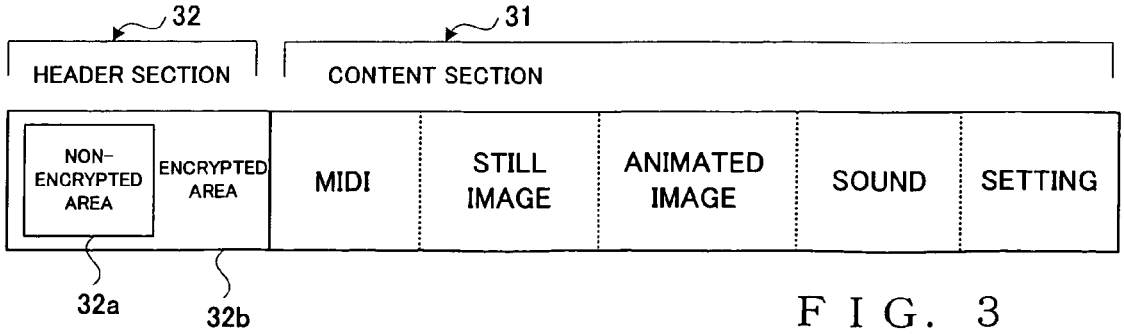
FIG. 3

ELECTRONIC MUSIC APPARATUS CAPABLE OF REPRODUCING COMPOSITE MUSIC FILE, AND PROGRAM THEREFOR

BACKGROUND OF THE INVENTION

The present invention relates to an electronic music apparatus capable of efficiently reproducing music-related content included in a composite music file having a plurality of types of music-related content included together therein as a single file, a method for reproducing such a composite music file, and a computer program for reproduction of a composite music file. Note that the term "electronic music apparatus" is used herein to mean every conceivable electronic equipment, such as electronic musical instruments, automatic performance apparatus, audio reproduction apparatus, effecters, automatic music composition apparatus, musical score creation/display apparatus and computers having some type of music or sound reproducing software, which have music-related reproduction/display functions.

Generally, examples of music-related content (hereinafter called "music content") include various types of data, such as MIDI (Musical Instrument Digital Interface) music piece data, musical score data, still image data, setting information (e.g., registration data), sound data (audible waveform sample data) and the like, and each such data is distributed as separate or independent music content data. Also, for reproduction/display of such music content data, particular software or apparatus functions corresponding to the types of the data are selectively used. For example, MIDI music piece data are reproduced by sequence software or sequencer function, musical score data are displayed by musical score display software or musical score display function, image data are displayed by image display software or image display function, registration data are taken in or input by automatic take-in software or take-in function, and so on. Namely, it has been conventional to reproduce/display various types of music content by starting up particular software or functions corresponding to the types of music content.

Because, for each of various music-related software or the like, the types of data or content corresponding to the software or the like are determined in advance, any file comprising content usable by the software or the like can be displayed using a predetermined icon, or can be displayed in such a manner that only the corresponding data usable by the software or the like are visible to a user.

Heretofore, there has also been known a technique capable of processing a plurality of types of music content during the course of execution of one application software. According to the technique, typically, a plurality of types of music software are incorporated into one application software by plug-in, and, when there has arisen a need to reproduce or display a particular type of music content during the course of execution of the application software, plug-in software corresponding to the particular type of music content is stated up. With the known technique, each of the various types of music content, usable by the various types of music software, exists and is managed as a separate file.

Nowadays, personal computers and the Internet are being used widely, and there have been great demands for emergence of a composite music file having a plurality of types of music content incorporated together therein as a single file and emergence of integrated software capable of handling (i.e., reproducing/displaying) such a composite music file, in order to meet a variety of needs of the users and pursue further multi-functionality and ease of use. However, neither such a composite music file nor integrated software capable of handling the composite music file has emerged to date. Besides, there has emerged no full-fledged integrated software capable of reproducing/displaying a composite music file as mentioned above.

If such a composite music file has only one kind of extension (e.g., ".cxx") attached to the name of the file, then it is impossible for the user to see what types of music content the composite music file includes. To allow the user to see what types of music content the composite music file includes, it is necessary to provide a different extension per combination of the music content types included in the composite music file. For example, a plurality of different extensions may be provided by allocating appropriate numeric characters to the locations of "xx" in the extension (".cxx"). Further, the file may be made easier to visually identify, by allocating a different icon to each of the different extensions. However, because a multiplicity of combinations of music content types are possible, associating different extensions and different icons with the individual combinations would undesirably result in a huge number of the extensions or icons, increased difficulty for the user to make full or efficient use of the huge number of the extensions or icons, and hence more troublesome management by a computer.

In stead of allowing the structural contents (i.e., substance: throughout the specification, this term "contents" should not be confused with the term "content") of a composite music file, which may include a plurality of types of music content in diversified combinations, to be identified via different extensions, the user can actually open the composite music file to view the structural contents and thereby identify what types of music content are included in the composite music file. However, because, nowadays, most of the music content is supplied to interested users in encrypted form in order to protect copyrights of the music content, the contents of the music content can not be ascertained prior to decryption of the music content. The composite music file has to be subjected to a decryption process based on a public key and other information, which tends to be a cumbersome and time-consuming process. Because the cumbersome decryption process is needed to open the encrypted composite music file and view the file's structural contents and then identify what types of music content are included in the file, the above-mentioned approach is inconvenient.

Further, if content downloaded via the Internet or the like comprises such a composite music file, the user can not readily figure out what type of application software should be used to reproduce or process otherwise the content, which is also very inconvenient.

SUMMARY OF THE INVENTION

In view of the foregoing, it is an object of the present invention to provide an improved apparatus which allows a user to readily identify types of music content included in a composite music file and also allows the user to readily prepare music software to be used for reproduction of the composite music file, as well as an improved composite music file reproduction method and computer program related thereto.

The present invention provides an improved electronic music apparatus, which comprises: a storage section that stores a plurality of types of music software, each of the plurality of types of music software being capable of reproducing and/or displaying a plurality of types of music-related content; an input section that inputs a desired composite music file, the composite music file comprising a content section including a plurality of types of music-related content and a header section including content type information indicative of the types of music-related content, wherein at least the content type information of the header section in the composite music file is in a non-encrypted form; and a control section that, when a composite music file has been input via the input section, reads out the content type information included in the header section of the input composite music file and, on the basis of the read-out the content type information, selects one of the plurality of types of music software, stored in the storage section, to thereby start up the selected music software.

Composite music file, including a plurality types of music-related content, is composed of a content section including the plurality of types of music-related content, and a header section including content type information of the plurality of types of music-related content. At least the content type information included in the header section is in a non-encrypted form. What types of music-related content the composite music file is composed of can be readily known by a user merely accessing the header section without accessing the content section and without requiring any particular decrypting process, because the content type information of the header section is not encrypted. Once a composite music file is input via the input section, the content type information is read out from the header section of the input composite music file, and one given music software is selected, on the basis of the read-out content type information, from among the plurality of types of music software stored in the storage section, so that the thus-selected music software is automatically started up. Thus, the present invention can eliminate a need for the user to judge which music software should be used, as well as a need to start up the necessary music software through manual operation by the user. As a consequence, it is no longer necessary to assign a different extension to each of various combinations of a plurality of types of music-related content of composite music files so as to identify each of such combinations, and thus the present invention can prevent an increase in the necessary number of the extensions. The present invention can also be suitably applied to cases where different extensions are assigned to various combinations of a plurality of types of music-related content of composite music files so as to appropriately identify the combinations.

The present invention may be constructed and implemented not only as the apparatus invention as discussed above but also as a method invention. Also, the present invention may be arranged and implemented as a software program for execution by a processor such as a computer or DSP, as well as a storage medium storing such a software program. Further, the processor used in the present invention may comprise a dedicated processor with dedicated logic built in hardware, not to mention a computer or other general-purpose type processor capable of running a desired software program.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

For better understanding of the objects and other features of the present invention, its preferred embodiments will be described hereinbelow in greater detail with reference to the accompanying drawings, in which:

FIG. 1 is a block diagram schematically showing an example hardware setup of an electronic music apparatus in accordance with an embodiment of the present invention, which is in the form of an electronic musical instrument;

FIG. 2 is a table showing relationship between a plurality of types of music software and one or more types of music data (content) reproducible or displayable by these music software;

FIG. 3 is a diagram showing an example organization of a composite music file containing a plurality of types of music content reproducible or displayable by any of the various types of music software of FIG. 2;

DETAILED DESCRIPTION OF THE INVENTION

Figure 4:
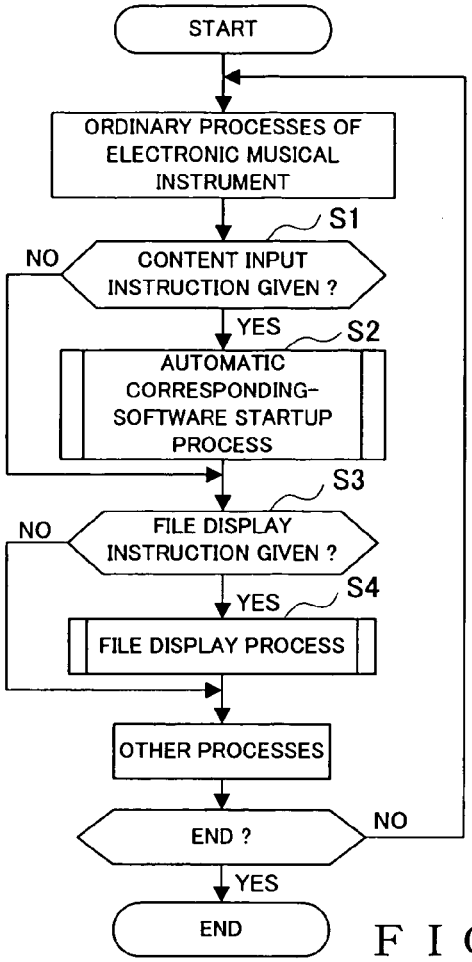
FIG. 4 is a flow chart showing an example of a main routine of a processing program related to the embodiment of the present invention.

FIG. 1 is a block diagram schematically showing an example hardware setup of an electronic music apparatus in accordance with an embodiment of the present invention. The electronic music apparatus is, for example, in the form of an electronic musical instrument 1 provided with a music-performing keyboard 10. The electronic musical instrument 1 includes a microcomputer section that in turn includes a CPU (Central Processing Unit) 11, a ROM (Read-Only ROM) 12 and a RAM (Random Access Memory) 13. The CPU 11 controls operation of the entire electronic musical instrument 1. To the CPU 11 are connected, via a bus 14, the ROM 12, RAM 13, keyboard 10, operation section 15, display device 16, portable (removable)-storage-medium read/write device 17, hard disk device (HDD) 18, tone generator device 19, sound system 20, flash memory 21 and communication interface (I/F) 22. Portable storage medium, such as a memory card 17A, can be removably set in the portable-storage-medium read/write device 17. External storage device, such as a CD-ROM drive 23, or other portable-storage-medium read/write device is connectable to the communication interface 22 in accordance with suitable communications standards, such as the USB standard. The electronic musical instrument 1 is connectable, via the communication interface 22, to a communication network, such as the Internet X. Further, this electronic musical instrument 1 is constructed to perform not only ordinary musical instrument functions, such as a manual performance function, automatic performance function and tone setting function, but also music-related functions, such as a musical score creation/display function and music teaching function. The electronic musical instrument 1 is also constructed to perform various functions of ordinary personal computers, such as a function for accessing a desired sire on the Internet X so as to acquire desired data (content) and/or program.

In the electronic musical instrument 1, a plurality of types of music software (application software) capable of reproducing/displaying one or more types of music-related content (hereinafter referred to as "music content") are stored in a suitable storage means, such as the hard disk 18. Such various types of music software may be stored (installed) in the hard disk 18 from the beginning, or may be first stored in a CD-ROM 23A and then loaded, via the drive 23, from the CD-ROM 23A to the hard disk 18 for installation therein. Alternatively, the various types of music software may be downloaded to the hard disk 18 via a communication network, such as the Internet X, and then installed in the hard disk 18. FIG. 2 is a table showing relationship between several types of music software and several types of music content reproducible or displayable by these music software.

In the section "Type of Music Content" of FIG. 2, "MIDI" represents MIDI music piece data, "musical score" represents musical score data, "still image" represents still image data, "animated image" represents animated image data, "sound" represents sound data (audible waveform sample data), and "setting" represents setting information, such as registration data, for setting a tone, performance or the like. As known in the art, these data differ from one another in data format, and reproduction means (reproduction engines) for reproducing these data also differ among the data. Further, in the section "Type of Software" of FIG. 2, the respective types of the music software are indicated, and "○" and "–" indicated in the section "Type of Music Content" in relation to the individual music content type indicate whether or not the music software in question is capable of reproducing (or displaying) the type of music content: specifically, the "○" mark indicates that the music software in question is capable of reproducing (or displaying) the type of music content, while the "–" mark indicates that the music software in question is not capable of reproducing (or displaying) the type of music content. Namely, as the music software in question is started up, the appropriate reproduction means (reproduction engine) can be started up for each type of music content corresponding to the "○" mark.

The following paragraphs outline the various types of music software illustrated in FIG. 2, although they may be already popularly known today.

A) Music Teaching Software:

This is software related to music teaching, which is capable of executing an automatic performance on the basis of MIDI music piece data and displaying a musical score. This software is also capable of displaying a current reproduced position in synchronism with the automatic performance, and executing the automatic performance while muting a designated performance part to allow the user to practice playing the muted designated performance part. Further, this music teaching software can display animated images indicative of a performance operation sequence or technique in relation to the automatic performance, on the basis of animated image data picked up by a video camera (liver-action images) or created by computer graphics or otherwise. The music teaching software can also input sound data (audible waveform sample data) and use the sound data as a sound source waveform of a tone to be reproductively performed. The music teaching software can also communicate tone setting information (e.g., registration data) with another electronic musical instrument. In this way, the music teaching software is capable of using a plurality of types of music content as indicated by the "○" marks in the table of FIG. 2.

B) Musical Score Display/Automatic Performance Software:

This is software intended primarily to make a musical display. This musical score display/automatic performance software comprises software of a type that creates and displays a simplified musical score on the basis of MIDI music piece data alone, and software of a type that creates and displays an advanced musical score on the basis of, in addition to note information etc. corresponding to MIDI music piece data, musical score display data having data dedicated to musical score display. When executing an automatic performance based on MIDI music piece data, the musical score display/automatic performance software can visually indicate a current performed position on the displayed musical score. Therefore, the musical score display/automatic performance software is capable of using a plurality of types of music content as indicated by the "○" marks in the table of FIG. 2.

C) Multimedia Software:

This is software corresponding to multimedia that include music, sound, still image, animated image, etc., which is therefore capable of using various music content indicated by the "○" marks in the table of FIG. 2. However, this multimedia software, which merely corresponds to multimedia widely and shallowly, is not suited for handling a given type of music content with high quality.

D) Automatic Performance/Singing Software:

This is software which is capable of, in addition to an automatic performance of a music piece, synthesis of a sing with human voices. More specifically, this automatic performance/singing software can not only execute an automatic performance based on MIDI music piece data, but also can bring in sound data (audible waveform sample data) from the outside and allow the brought-in or input sound data to be used as a sound source waveform of a reproductively-performed sound (e.g., singing voice). Therefore, the automatic performance/singing software is capable of using a plurality of types of music content as indicated by the "○" marks in the table of FIG. 2.

E) Setting Information Exchange Software:

This is software which is capable of exchanging or communicating various setting information, such as registration data, with another electronic musical instrument. Therefore, this setting information exchange software is capable of using various music content as indicated by the "○" marks in the table of FIG. 2.

F) Sampling Software:

This is software which can bring in sound data (audible waveform sample data) from the outside and allow the brought-in or input sound data to be used as a sound source waveform of a tone. Therefore, the sampling software is capable of using a plurality of types of music content as indicated by the "○" marks in the table of FIG. 2.

G) Sequencer Software:

This is software for a sequencer (automatic performance function). Therefore, the sequencer software is capable of using a plurality of types of music content as indicated by the "○" marks in the table of FIG. 2.

The following paragraphs describe an example of a composite music file that includes a plurality of types of music content reproducible or displayable via any of the various music software as described above.

FIG. 3 shows an example organization of the composite music file. The composite music file of FIG. 3 generally comprises a content section (content body) 31 including the plurality of types of music content, and a header section 32 including content type information indicative of the types of music content included in the composite music file. Predetermined extension, e.g. ".c**", is assigned to the file name of the composite music file, to indicate that the file is a composite music file; a suitable numeric character may be allocated to the location of "*". This extension need not differ per combination of the plurality of types of music content included in the composite music file; therefore, from the extension ".c" of the composite music file, it is not possible to identify the respective types of the music content included in the composite music file. The header section 32 includes a non-encrypted area 32***a* and an encrypted area 32*b*, and the above-mentioned content type information of the plurality of types of music content included in the music file is stored in the non-encrypted area 32*a*. For example, the content type information may be extensions of the individual types of music content etc. included in the composite music file. Namely, because each type of content in the composite music file has a publicly-known extension, e.g. ".mid" for MIDI music piece data, ".sxf" for musical score data, ".jpg", ".tif", ".bmp" or the like for still image data, ".mpg" for animated image data, ".wav" for sound data, ".rst" for registration data and so on, these extension information may be stored, as the type information of the music content included in the composite music file, in the non-encrypted area 32*a* in non-encrypted form. Of course, any other suitable identification information than the extension information may be stored, as the content type information of the music content, in the non-encrypted area 32*a*. With the content type information of the plurality of types of music content included in the music file thus stored in the non-encrypted area 32*a* in non-encrypted form, it is possible to promptly read the music content type information from the non-encrypted area 32*a* of the header section 32, without any particular decryption process required, when the contents (this term "contents" should not be confused with the term "content") of the music file are to be read out mechanically. Note that other information, such as the file name information, data size information and information indicative of a security scheme employed, may also be stored in the non-encrypted area 32*a* of the header section 32. In the encrypted area 32*b* of the header section 32, there are stored header information of a type that has to be protected from unauthorized copying, such as encryption information (encryption scheme, encryption key, etc.) corresponding to the security scheme.

The music content stored in the content section 31 has previously been subjected to a predetermined encryption process for protection from unauthorized copying. In the illustrated example of FIG. 3, five different types of music content: MIDI music piece data; still image data; animated image data; sound data; and setting information, are stored in the content section 31. Specific contents of the individual content may be chosen as desired and therefore will not be described in detail. Generally, the individual items of content included in the composite music file are directed to mutually-related contents. For example, the still image data may include photos of a composer, lyric writer, representative player, etc. of the music pieces which are stored as the MIDI music piece data. Further, the animated image data may include data of animated images of a model performance scene in the music piece. Further, the sound data may include narrative voice data explaining usage and instructions of the composite music file. Furthermore, the setting information may include information indicative of a performance tempo, tone color, accompaniment style (rhythm), effect, key region division, etc. Note that the various types of music content to be stored in the content section 31 may be encrypted by use of a common or same encryption scheme or different encryption schemes. Furthermore, only one or some of the types of music content may be encrypted with the remaining types of music content left unencrypted. Alternatively, all of the data and content in the composite music file may be left unencrypted.

Next, a description will be given about examples of processing programs executed in the instant embodiment by the computer (CPU 11) provided in the electronic musical instrument 1, with reference to FIGS. 4-6. FIG. 4 is a flow chart of a main routine (main flow), in which processes relevant to the instant embodiment of the invention are performed in addition to ordinary processes normally performed in the electronic musical instrument, e.g., initialization process upon startup of the main routine, panel operation/display process, keyboard performance detection process, tone generation process responsive to the keyboard performance detection, automatic performance process, key depression guiding display process, etc.).

Now explaining the processes relevant to the instant embodiment, once an instruction is given for inputting desired music content to the electronic musical instrument 1 from the outside (step S1), a process is performed for automatically starting up corresponding software at step S2. For example, this automatic corresponding-software startup process is performed at step S2 when the desired music content is to be downloaded into the electronic musical instrument 1. Detailed example of the automatic corresponding-software startup process of step S2 is illustrated in FIG. 5.

Figure 5:
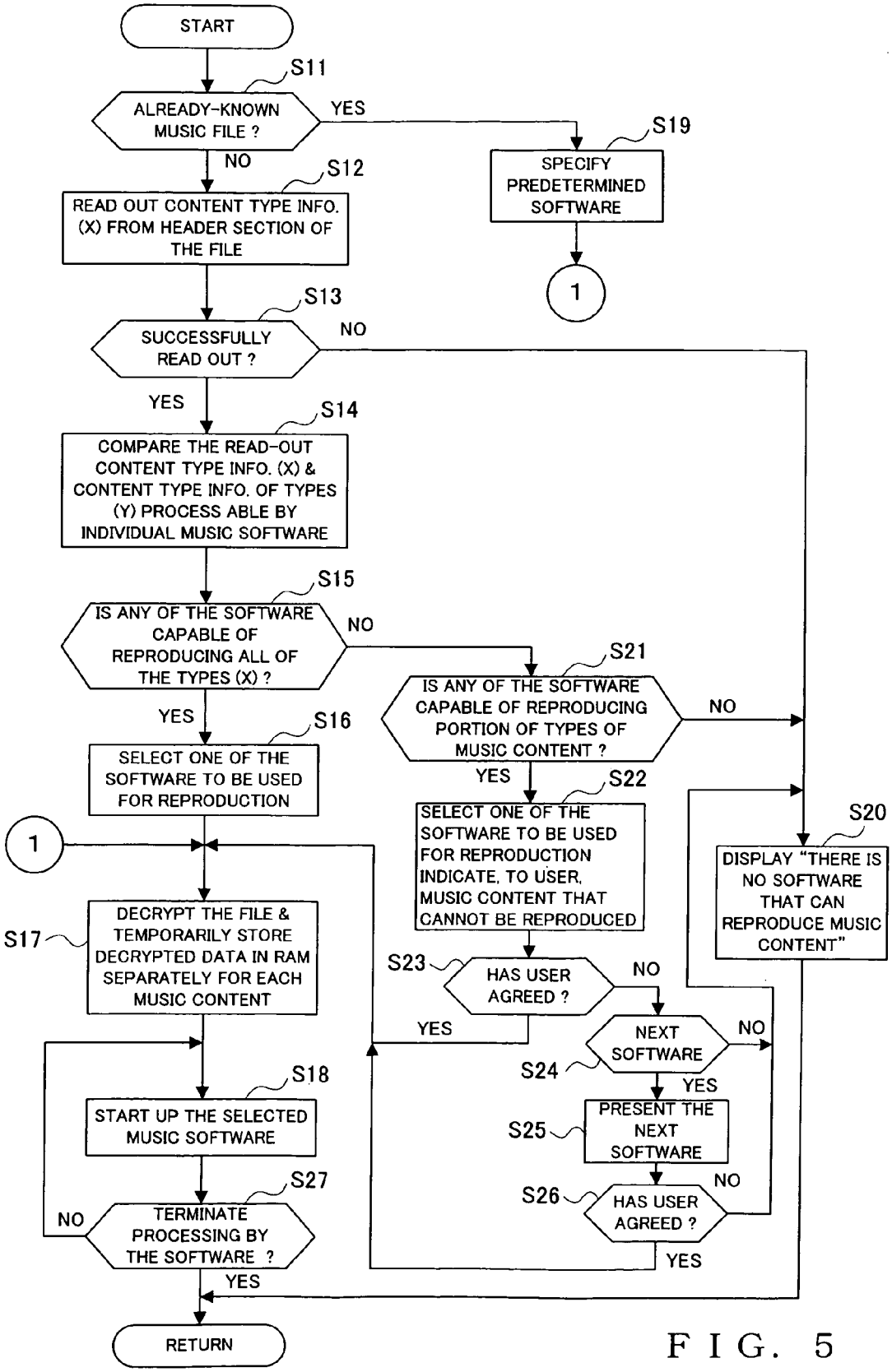
FIG. 5 is a flow chart showing an example of an automatic corresponding-software startup process in FIG. 4.

In FIG. 5, a determination is first made at step S11, on the basis of the extension attached to the file name of the music content to be downloaded, as to whether or not the music content in question is a single already-known (identified) music file. If, for example, the data type of the music file is "MIDI music piece data", the data type can be readily identified from the MIDI extension ".mid" attached to the file name. If the data type of the music file is "musical score data", the data type can be readily identified from the extension of the musical score data ".sxf" attached to the file name. If the music content in question is a single already-known music file as determined at step S11 (YES determination at step S11), the process goes to step S19 to identify or specify, on the basis of the extension of the music file, the type of the music software to be reproduced, and then jumps to step S17.

If the music content to be downloaded is a novel composite music file employed (proposed) in relation to the present invention or other file than a single already-known music file, then a NO determination is made at step S11, and thus the process proceeds to step S12. At step S12, access is made to the header section of the music content to be downloaded, and the CPU 11 reads out the content type information (provisionally indicated herein by reference character X) included in the header section of the music file, assuming that the music content to be downloaded is a composite music file proposed in relation to the present invention as shown in FIG. 3. If the music file is such a composite music file, the content type information X of various music content included in the music file is prestored in the header section 32 in non-encrypted form, and thus the content type information X can be read out promptly at step S12 without any particular decryption process required. Therefore, a YES determination is made at step S13 which is directed to determining whether or not the content type information X has been successfully read out, and the process moves on to step S14. If, on the other hand, the music content in question is not a novel composite music file proposed in relation to the present invention, the content type information X can be read out successfully, so that a NO determination is made at step S13 and then the process jumps to step S20.

At steps S14, S15 and S16, particular music software is determined, on the basis of the read-out content type information X, which is capable of reproducing/displaying all of the types of music content included in the composite music file. For this purpose, in the storage means, such as the hard disk 18, there is stored, in a table format, relationship between a plurality of types of music software (A-G of FIG. 2) usable in the electronic musical instrument 1 and types of music content reproducible/displayable by these music software. Thus, at step S14, a comparison is made between the content type information X read out at step S13 and information indicative of the types of content processable by the music software (A-G) in the table (this content type information will be provisionally indicated by "Y" to distinguish from the content type information X in the composite music file). At step S15, a determination is made, on the basis of the comparison results, as to whether or not any of the music software (A-G) is capable of reproducing all of the types (X) of music content included in the composite music file. With a YES determination at step S15, the process moves on to step S16 to determine, from among the music software capable of reproducing all of the types (X), one particular music software to be used for reproducing the composite music file to be downloaded. Then, the process goes to step S17. If, in this case, it has been determined that two or more of the music software (A-G) are capable of reproducing all of the types (X) of music content included in the composite music file, any one of the music software is selected, at step S16, by priority basis in accordance with a suitable criterion or condition; for example, one of the music software which has the highest fitness or suitability may be selected on a priority basis. For example, if the composite music file includes two types of music content: "MIDI data"; and "sound data", then four types of music software: (A) Music Teaching Software; (C) Multimedia Software; (D) Automatic Performance/Singing Software; and (G) Sequencer Software, are listed up at step S15 as software capable of reproducing the two types of music content. In this instance, the Automatic Performance/Singing Software (D) and Sequencer software (G), having the least number of corresponding music content types (i.e., the number of types of music content usable on the software), is selected with priority as music software having higher fitness or suitability. Let it be assumed that, when two or more music software has been selected on a priority basis as in the illustrated example, any one of the two or more music software is selected with priority in accordance with a predetermined hierarchy; for example, the Automatic Performance/Singing Software may be selected with priority.

With a NO determination at step S15, the process branches to step S21, where a determination is made as to whether there is any music software (A-G) capable of reproducing a portion (i.e., one or more) of the types of music content included in the composite music file to be downloaded. If answered in the affirmative at step S21, the process goes to step S22, where one music software to be used for reproducing the composite music file to be downloaded is selected from among the music software (A-G) capable of reproducing a portion (one or more) of the types of music content included in the composite music file. In this case too, let it be assumed that, if it has been determined that there is present two or more music software (A-G) capable of reproducing a portion of the types (X) of music content included in the composite music file, any one of the music software is selected on a priority basis in accordance with a suitable criterion or condition, as in step S16 above. By thus identifying the music software capable of only reproducing a portion of the types (X) of music content, it is possible to identify the other music content that can not be reproduced by the identified music software. At step S22, an operation is carried out for clearly indicating to the user which of the types of music content are non-reproducible by the identified music software, e.g., indicating the selected one music software and the types of music content that can not be reproduced by the selected music software. In turn, the user ascertains such indications of the music software and the types of music content and then replies whether or not he or she agrees to using the selected music content. At next step S23, a further determination is made as to whether the user's reply is indicative of agreement to the use of the selected music content. With an affirmative (YES) determination at step S23, the process goes to step S17, while, with a negative (NO) determination at step S23, the process branches to step S24.

At step S24, it is further determined whether, among the music software (A-G) capable of reproducing a portion of the types (X) of music content included in the composite music file to be downloaded, there is another music software (in other words, next candidate music software) to be presented to the user. If so, the process goes to step S25 to present the next candidate music software to the user. In turn, the user ascertains such presentation and replies whether or not he or she agrees to using the candidate music software. At next step S26, a further determination is made as to whether the user's reply is indicative of agreement to the use of the next candidate music software. With an affirmative determination at step S26, the process goes to step S17, while, with a negative determination at step S26, the process reverts to step S24. Then, the operations of steps S24-S26 are repeated to present further next candidate music software until user's agreement to the use of the presented candidate music software is obtained. When it has been determined that there is no longer other candidate music software without the user agreeing to the use of any candidate music software, a NO determination is made at step S24, so that the process branches to step S20. When the process has branched to step S20 from the NO determination from each of steps S13, S21 and S24, a predetermined message, e.g. "There is no software that can reproduce music content." is issued to the user, after which the process is brought to an end.

Once any one suitable music software has been identified through the above-described operation of any one of steps S16, S19, S22 and S25, the process of FIG. 5 moves on to step S17. At step S17, the composite music file to be downloaded is decrypted and the resultant decrypted data are temporarily stored into the RAM 13 for each of the various music content stored in the content section 31, as preparations for automatically starting up the identified music software. Needless to say, if the composite music file to be downloaded is a file not encrypted at all, the decryption operation of step S17 is unnecessary. At next step S18, the one music software identified in the above-described manner is started up automatically so that the music software can be executed in response to input operation by the user or the like. As the automatically-started-up music content is executed, the plurality of types of music content included in the composite music file are reproduced/displayed. Of course, the downloaded composite music file may be stored in a suitable nonvolatile storage means at step S17 or S18. At step S27, a further determination is made as to whether or not any operation has been performed for terminating the processing by the music software; the processing by the music software started up at step S18 is continued till such operation for terminating the processing is performed.

Referring back to the main flow of FIG. 4, when a music content file to be downloaded (or having been downloaded) is to be visually displayed, a predetermined file display instructing operation may be given through mouse clicking operation or the like. At step S3, a determination is made as to whether or not such file display instructing operation has been performed. With an affirmative answer at step S3, a file display process is carried out at step S4, a detailed example of which is illustrated in FIG. 6.

Figure 6:
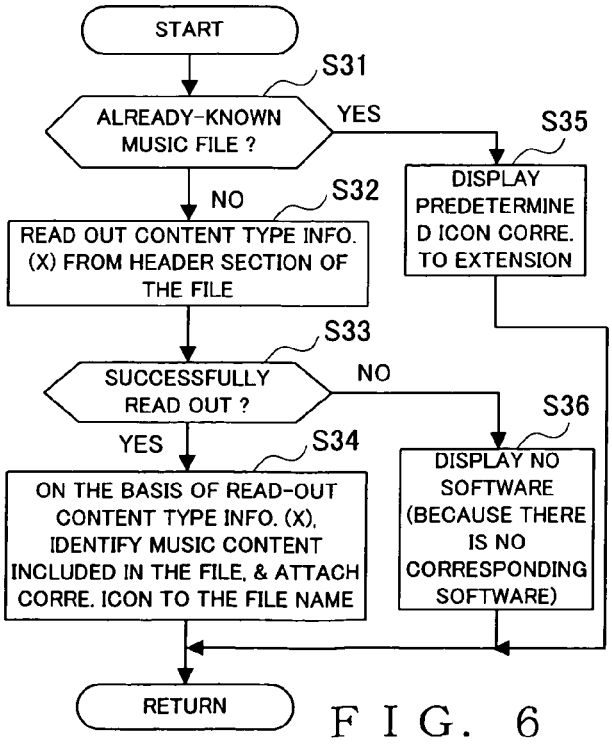
FIG. 6 is a flow chart showing an example of a file display process in FIG. 4.

In FIG. 6, steps S31, S32 and S33 are directed to operations similar to those of steps S11, S12 and S13 of FIG. 5. Namely, at step S31, a determination is made, on the basis of the extension attached to the file name of the music content to be downloaded, as to whether or not the music content in question is a single already-known music file. If the music content in question is a single already-known music file as determined at step S31 (YES determination at step S31), the process goes to step S35, where a predetermined icon, allocated in advance to the already-known music file, is attached to the file name of the music content and displayed along with the file name. If, on the other hand, the music content in question is other file than a single already-known music file, the process proceeds to step S32. At step S32, the CPU 11 reads out, from the header section of the music content file (composite music file) to be downloaded (or having been downloaded), the content type information (X) indicative of various types of music content included in the music content file. If the file in question is a composite music file of the novel type proposed in relation to the instant embodiment of the present invention, the content type information (X) indicative of various types of music content included in the music content file can be read out from the header section 32, a YES determination is made at following step S33, so that the process of FIG. 6 moves on to step S34. If the content type information (X) could not be read out, a NO determination is made at step S33, so that the process branches to step S36; because the electronic musical instrument 1 of the present invention is not provided with corresponding reproduction software (i.e., software necessary for reproducing the music content file to be downloaded or having been downloaded), the process is brought to an end without performing any further operation.

At step S34, a combination of the types of the music content, included in the composite music file to be downloaded (or having been downloaded), is identified on the basis of the content type information (X) read out at step S33, and an icon corresponding to the identified combination of the types is attached to the name of the composite music file and displayed along with the file name. The icon may be attached, for example, in any one of the following two ways. According to one of the ways, a particular icon is allocated in correspondence with the combination of the data types of the music content. For example, different icons corresponding to various combinations of various data types of music content are preset (e.g., a specific icon (a) for a combination of MIDI data and musical score data, a specific icon (b) for a combination of MIDI data and sound data, and a specific icon (b) for a combination of MIDI data, musical score data and sound data), and one of the preset icons, corresponding to the identified combination of the types, is selected and attached to the composite music file name. According to the other way, different icons are attached in association with individual music software (A-G) as shown in FIG. 2. In this case, operations similar to those of steps S14-S16 and S21-S26 of FIG. 5 are carried out so as to specify one of the music software (A-G) that appears to be suitable or optimal for the content type information (X) read out at step S33, and one of the icons preset in association with the identified music software (A-G) is attached to the composite music file name and displayed along with the file name. If the music teaching software has been determined to be optimal software, a predetermined one of the preset icons, which corresponds to the music teaching software, is attached.

Referring back to FIG. 4, the main routine is repeated until predetermined ending operation is performed by the user or human operator. Therefore, the order in which the automatic corresponding-software startup operation (step S2) and file display operation (step S4) are actually carried out is not limited to the one illustrated in the figure, and the file display operation (step S4) may of course be carried out prior to the automatic corresponding-software startup operation (step S2). Namely, by carrying out the operations of steps S3 and S4 for music content to be downloaded, it is possible to display the file name and type of the content included therein. Also, by carrying out the operations of steps S3 and S4 of the main routine for music content having been downloaded, the user can cause the file name and type of the content included therein to be displayed for confirmation.

What is claimed is:

1. An electronic music apparatus comprising:

a storage section that stores a plurality of types of music software, each of the plurality of types of music software being capable of at least one of reproducing and displaying a plurality of types of music-related content;

a table that stores, for each of the plurality of types of music software stored in said storage section, content type information of music-related content reproducible by the music software;

an input section that inputs a desired composite music file, the composite music file comprising a content section including a plurality of types of music-related content and a header section including content type information indicative of the types of music-related content, wherein at least the content type information of the header section in the composite music file is in a non-encrypted form; and a control section that, when a composite music file has been input via said input section, reads out the content type information included in the header section of the input composite music file and selects, from said storage section, one of said plurality of types of music software suitable for the input composite music file on the basis of a comparison, with reference to said table, between the read-out content type information and the content type information for each of said plurality of types of music software stored in said storage section to thereby start up the selected music software, wherein said control section is configured to:

determine whether said plurality of types of music software stored in said storage section include music software capable of reproducing all of the types of music-related content indicated by the read-out content type information;

if it has been determined that said plurality of types of music software stored in said storage section include music software capable of reproducing all of the types of music-related content, select said music software capable of reproducing all of the types of music-related content, wherein, if it has been determined that said plurality of types of music software stored in said storage section include two or more music software capable of reproducing all of the types of music-related content, said control section selects one of said two or more music software having the higher suitability in accordance with a predetermined selection criterion;

if it has been determined that said plurality of types of music software stored in said storage section include no music software capable of reproducing all of the types of music-related content, further determine whether said plurality of types of music software stored in said storage section include music software capable of reproducing one or more, but not all, of the types of music-related content; and if it has been determined that said plurality of types of music software stored in said storage section include music software capable of reproducing one or more, but not all, of the types of music-related content, select said music software capable of reproducing one or more of the types of music-related content, wherein, if it has been determined that said plurality of types of music software stored in said storage section include two or more music software capable of reproducing one or more, but not all, of the types of music-related content, said control section selects one of said two or more music software having higher suitability in accordance with the predetermined selection criterion.

2. An electronic music apparatus as claimed in claim 1 wherein said control section associates a predetermined icon with the input composite music file on the basis of the content type information read out from the header section of the input composite music file so that the predetermined icon can be used when the input composite music file is displayed on a display.

3. An electronic music apparatus as claimed in claim 1 wherein said input section inputs a desired composite music file from outside said electronic music apparatus via a communication interface.

4. An electronic music apparatus as claimed in claim 1 wherein the plurality of types of music-related content are any of MIDI music piece data, musical score data, still image data, animated image data, tone-generation setting information and audio data.

5. An electronic music apparatus as claimed in claim 1 which is electronic equipment having a music-related reproduction/display function including at least one of an electronic musical instrument, automatic performance apparatus, audio reproduction apparatus, effecter, automatic music composition apparatus, and computer equipped with a music or sound reproducing software.

6. An electronic music apparatus as claimed in claim 1 wherein said predetermined selection criterion is to select one of said two or more music software in accordance with a particular number of types of music content reproducible or displayable on the two or more music software.

7. An electronic music apparatus as claimed in claim 6 wherein said predetermined selection criterion is to select one of the two or more music software on which a least number of types of music content are reproducible or displayable.

8. A method for reproducing a composite music file in a electronic music apparatus, said electronic music apparatus including a storage section that stores a plurality of types of music software, each of the plurality of types of music software being capable of at least one of reproducing and displaying a plurality of types of music-related content, and a table that stores, for each of the plurality of types of music software stored in said storage section, content type information of music-related content reproducible by the music software, said method comprising:

a step of inputting a desired composite music file, the composite music file comprising a content section including a plurality of types of music-related content and a header section including content type information indicative of the types of music-related content, wherein at least the content type information of the header section in the composite music file is in a non-encrypted form; and a control step of, when a composite music file has been input via said step of inputting, reading out the content type information included in the header section of the input composite music file and selecting, from said storage section, one of said plurality of types of music software suitable for the input composite music file on the basis of a comparison, with reference to said table, between the read-out content type information and the content type information for each of said plurality of types of music software stored in said storage section to thereby start up the selected music software, wherein said control step includes:

determining whether said plurality of types of music software stored in said storage section include music software capable of reproducing all of the types of music-related content indicated by the read-out content type information;

if it has been determined that said plurality of types of music software stored in said storage section include music software capable of reproducing all of the types of music-related content, selecting said music software capable of reproducing all of the types of music-related content, wherein, if it has been determined that said plurality of types of music software stored in said storage section include two or more music software capable of reproducing all of the types of music-related content, said control step selects one of said two or more music software having higher suitability in accordance with a predetermined selection criterion;

if it has been determined that said plurality of types of music software stored in said storage section include no music software capable of reproducing all of the types of music-related content, further determining whether said plurality of types of music software stored in said storage section include music software capable of reproducing one or more, but not all, of the types of music-related content; and if it has been determined that said plurality of types of music software stored in said storage section include music software capable of reproducing one or more, but not all, of the types of music-related content, selecting said music software capable of reproducing one or more of the types of music-related content, wherein, if it has been determined that said plurality of types of music software stored in said storage section include two or more music software capable of reproducing one or more, but not all, of the types of music-related content, said control step selects one of said two or more music software having higher suitability in accordance with the predetermined selection criterion.

9. A computer readable medium containing a group of instructions for causing a computer of an electronic music apparatus to perform a method for reproducing a composite music file in said electronic music apparatus, said electronic music apparatus including a storage section that stores a plurality of types of music software, each of the plurality of types of music software being capable of at least one of reproducing and displaying a plurality of types of music-related content and a table that stores, for each of the plurality of types of music software stored in said storage section, content type information of music-related content reproducible by the music software, said method comprising:

a step of inputting a desired composite music file, the composite music file comprising a content section including a plurality of types of music-related content and a header section including content type information indicative of the types of music-related content, wherein at least the content type information of the header section in the composite music file is in a non-encrypted form; and a control step of, when a composite music file has been input via said step of inputting, reading out the content type information included in the header section of the input composite music file and selecting, from said storage section, one of said plurality of types of music software suitable for the input composite music file on the basis of a comparison, with reference to said table, between the read-out content type information and the content type information for each of said plurality of types of music software stored in said storage section to thereby start up the selected music software, wherein said control step includes:

determining whether said plurality of types of music software stored in said storage section include music software capable of reproducing all of the types of music-related content indicated by the read-out content type information;

if it has been determined that said plurality of types of music software stored in said storage section include music software capable of reproducing all of the types of music-related content, selecting said music software capable of reproducing all of the types of music-related content, wherein, if it has been determined that said plurality of types of music software stored in said storage section include two or more music software capable of reproducing all of the types of music-related content, said control step selects one of said two or more music software having higher suitability in accordance with a predetermined selection criterion;

if it has been determined that said plurality of types of music software stored in said storage section include no music software capable of reproducing all of the types of music-related content, further determining whether said plurality of types of music software stored in said storage section include music software capable of reproducing only one or more, but not all, of the types of music-related content; and if it has been determined that said plurality of types of music software stored in said storage section include music software capable of reproducing one or more, but not all, of the types of music-related content, selecting said music software capable of reproducing only one or more of the types of music-related content, wherein, if it has been determined that said plurality of types of music software stored in said storage section include two or more music software capable of reproducing one or more, but not all, of the types of music-related content, said control step selects one of said two or more music software having higher suitability in accordance with the predetermined selection criterion.

* * * * *